United States Patent [19]

Young et al.

[11] Patent Number: 4,685,574

[45] Date of Patent: Aug. 11, 1987

[54] SHELF-SUPPORTED EXPANDABLE GRAVITY FEED SYSTEM

[75] Inventors: Raymond R. Young, Glenview; John F. Deffner, Lisle; Russell M. Barnes, Bloomingdale, all of Ill.

[73] Assignee: Visual Marketing Inc., Chicago, Ill.

[21] Appl. No.: 787,838

[22] Filed: Oct. 16, 1985

Related U.S. Application Data

[63] Continuation-in-part of Ser. No. 569,539, Jan. 10, 1984, which is a continuation-in-part of Ser. No. 452,374, Dec. 22, 1982, abandoned.

[51] Int. Cl.[4] ..... A47F 1/00

[52] U.S. Cl. ..... 211/59.2; 211/184; 312/42

[58] Field of Search ..... 211/59.2, 184; 312/42, 312/45, 72; 193/2 R, 38

[56] References Cited

U.S. PATENT DOCUMENTS

| | | | |
|---|---|---|---|
| 1,673,812 | 6/1928 | Dunn . | |
| 1,711,329 | 4/1929 | Short . | |
| 2,218,444 | 10/1940 | Vineyard | 211/59.2 |
| 2,492,919 | 12/1949 | Womack . | |
| 2,623,641 | 12/1952 | Shield . | |
| 2,888,145 | 5/1959 | Knott . | |
| 2,905,330 | 9/1959 | Lilja | 211/59.2 |
| 3,019,907 | 2/1962 | Belejack | 211/59.2 |
| 3,279,618 | 10/1966 | Bergstedt . | |
| 3,528,558 | 9/1970 | Williams . | |
| 3,784,022 | 1/1974 | Beesley | 211/59.2 |
| 4,006,824 | 2/1977 | Snediker et al. | 211/59.2 |
| 4,105,126 | 8/1978 | Deffner et al. | 211/59.2 |
| 4,119,208 | 10/1978 | Acker . | |
| 4,183,438 | 1/1980 | Huczek | 211/184 X |
| 4,191,296 | 3/1980 | Morgan . | |
| 4.228,903 | 10/1980 | Eckert | 211/59.2 |
| 4,314,648 | 2/1982 | Spamer | 211/59.2 |
| 4,356,923 | 11/1982 | Young et al. | 211/59.2 |
| 4,395,955 | 8/1983 | Pfeifer . | |
| 4,454,948 | 6/1984 | Spamer | 211/59.2 |
| 4,474,297 | 10/1984 | Zucker | 211/59.2 |
| 4,598,828 | 7/1986 | Young . | |

FOREIGN PATENT DOCUMENTS

| | | | |
|---|---|---|---|
| 712900 | 7/1965 | Canada | 221/14 |
| 2816999 | 10/1979 | Fed. Rep. of Germany . | |

*Primary Examiner*—Robert W. Gibson, Jr.
*Attorney, Agent, or Firm*—Willian Brinks Olds Hofer Gilson & Lione Ltd.

[57] ABSTRACT

A shelf-supported expandable gravity feed system is shown herein for displaying and dispensing cans, bottles, aseptic packages, and packages of cans or bottles. The apparatus includes two side members, having a ribbed support track, a wall, and two end members. A plurality of side members may be connected by a plurality of end members to form the expandable gravity feed system. To facilitate this interconnection the fasteners and end members include corresponding corrugated portions. The corrugated portions also permit varying the distance between interconnecting side members thereby expanding or contracting the width of the feed system. To provide a stable integral assembly the fasteners include a locking flange which is received within a recessed portion in the end member. Alternatively, the end members may include a locking flange which is received within a slot in the fastener. The shelf-supported expandable gravity feed system also includes a middle member which cooperates with the side members so that two separate rows of containers can be dispensed simultaneously. The middle members may also contain channels which receive vertical separators to allow stacking the gravity feed systems. An angular base member may be used to support the lowermost side members of the feed system, enabling the feed system to be inclined so containers may slide forward. The side member may include a pair of ribbed support tracks on either side of the middle member, permitting an infinite number of feed systems to be connected in parallel relationship to one another by alternately connecting a fastener to each end member on each side of the middle member.

21 Claims, 22 Drawing Figures

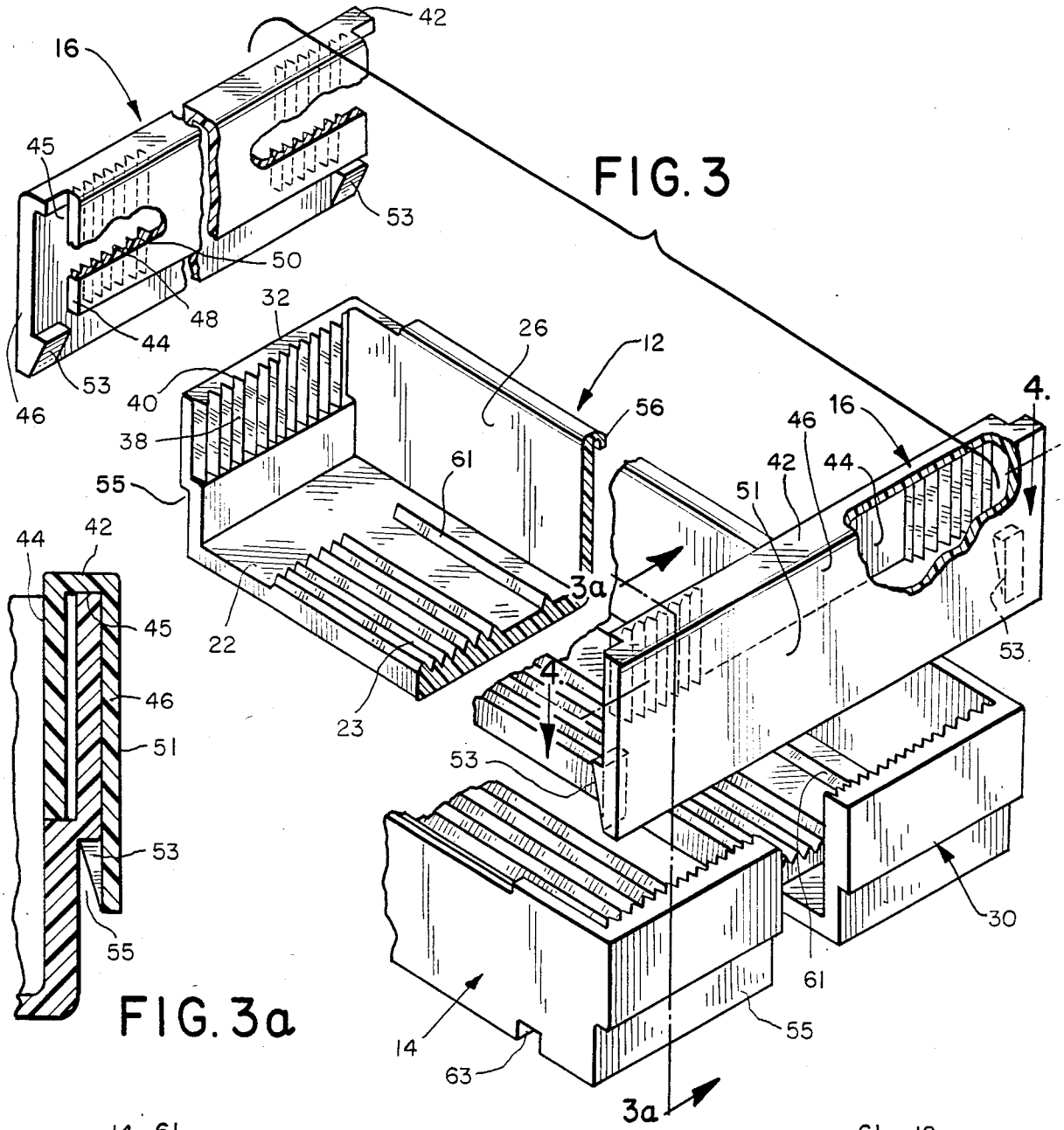
FIG. 3
FIG. 3a
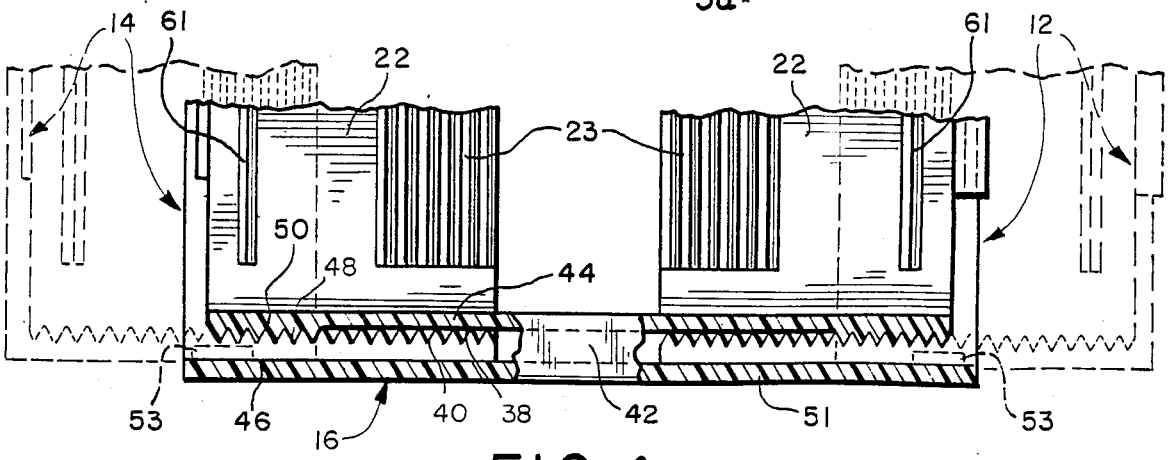
FIG. 4

SHELF-SUPPORTED EXPANDABLE GRAVITY FEED SYSTEM

This application is a continuation-in-part of co-pending patent application Ser. No. 569,539, filed Jan. 10, 1984, which in turn is a continuation-in-part of patent application Ser. No. 452,374, filed on Dec. 22, 1982, now abandoned.

BACKGROUND OF THE INVENTION

This invention relates generally to storage and dispensing apparatus such as used, for example, in supermarkets, merchandising establishments, and storage areas in recreation rooms. More particularly, the present invention is directed to an expandable gravity feed system for storing and dispensing bottles, cans, aseptic packages, and packages of bottles and cans from an inclined surface, or shelf.

Feed systems for dispensing cans or bottles are well known in the art. The function of these systems is to store and dispense an array of bottles or cans. These units are particularly useful in dispensing refrigerated cans or bottles of beverages.

Typically, these systems are designed to store and dispense containers which are supported on their sides so that they can roll down an inclined surface to the front of the unit where they are accessible to a customer or user. The size and shape of some beverage containers makes it undesirable to support these containers on their sides and roll them down an incline. To accommodate these containers, some gravity feed systems are designed to store and dispense containers in an upright position. To this end, these units utilize rollers, which are located in the feed system, or incline the feed system sufficiently to cause the container to slide in an upright position. Because of their high center of gravities some bottles are difficult to dispense in an upright position from these gravity feed systems; this is especially true of oversized liter and two liter containers. These containers will sometimes tip over rather than slide down the inclined surface of the system.

Prior gravity feed systems have also had a difficult time dispensing cardboard packaged "six packs" of cans or bottles. Because of the high coefficient of friction of cardboard, it has been difficult in prior art systems to slide a cardboard packaged "six pack" by gravity feed to the front of an inclined display rack.

Moreover, typically the prior gravity feed systems were not very versatile. They were usually designed to accommodate a certain size container and not readily adaptable to handle a variety of bottle and can dispensing needs.

SUMMARY OF THE INVENTION

The present invention is directed to an apparatus for storing and dispensing cans, bottles, aseptic packages, and packages of cans or bottles, which overcomes the disadvantages of the prior art apparatus. The shelf-supported expandable gravity feed system of this invention comprises at least a pair of identical side members, which include a support track, a wall and two end members. The side members are interconnected at their end members by fasteners.

To facilitate the interconnection of the side members, each of the end members is corrugated on at least one side with an alternating ridge and groove construction. The fasteners are correspondingly corrugated and include a pair of walls which define a channel, with at least one wall being corrugated on its inner side. The corrugated construction of the fasteners allows the fasteners to removably secure the side members in parallel relationship to each other. By varying the location of the fasteners, the width of the feed system may be expanded or contracted to accommodate a variety of container shapes and sizes.

To secure the fasteners in position once they have received a portion of the end members, the fasteners include a flange on the inner side of one of the walls. The flange cooperates with a recessed portion in the outer wall of the end member to securely position the fastener in place.

Another embodiment of the invention incorporates a flange on the end member. A pair of slots in one of the fastener walls is designed to receive a flange from adjacent end members, thereby securing the fastener to adjacent end members.

The expandable gravity feed system is constructed from a material with a coefficient of friction sufficiently low to allow a bottle located on the support tracks in an upright position to slide from one end of the system to the other end when the system is inclined at a slope of between 5° to 8°. To produce a more slidable surface, the support tracks are also ribbed.

In a preferred embodiment, two pairs of fasteners of differing lengths are provided. The lengths of the two pairs of fasteners are such that with these two pairs of fasteners the width of the expandable gravity feed system may be varied to accommodate a variety of sizes from a single bottle in an upright position to a "six pack" of cans or bottles.

In a further preferred embodiment, the expandable gravity feed system includes a removable middle member that divides the expandable gravity feed system so that two rows of containers may be supported and dispersed simultaneously by the system. In a preferred embodiment, the middle member includes a wall and two ribbed support tracks. The middle member may also include end flanges which are received within apertures in the fasteners.

In an additional preferred embodiment, the fasteners may include an elongated stop member for preventing bottles from falling over the fastener as they slide down the expandable gravity feed system.

In another preferred embodiment one of the side members includes a hook portion and the other side member is designed to be received by the hook portion. One side member also includes at least one tab and the corresponding side member includes at least one slot. Thus, it is possible to align two or more feed systems and secure them in parallel position to each other.

In another preferred embodiment, the side members are identically constructed. Each side member includes a middle member and two ribbed support tracks with one support track positioned on either side of the middle member. The side members include corrugated end members which permit a pair of fasteners to form a feed unit which may be expanded into an infinite number of parallel feed units by attaching a pair of fasteners and a side member to each successive side member. The middle member may also include channels which receive vertical separators so that the feed units may be stacked one atop the other.

Accordingly, an advantage of the present invention is that it provides an expandable gravity feed system which can accommodate a variety of bottle, can, and package dispensing needs.

A further advantage of the present invention is that it provides an expandable gravity feed system which includes as few as four components yet can accommodate a single bottle in an upright position and can be expanded to accommodate up to a "six pack" of bottles or cans.

A further advantage of the present invention is that the side members and fasteners cooperate to form a stable, integral assembled unit.

Another advantage of the present invention is that the support tracks are ribbed to provide a slidable surface for a bottle or can supported on the tracks.

A further advantage of the present invention is that each support track includes a single elongated rib which provides stability to an upright container as it slides down the support track.

Still another advantage of the present invention is that the side members include hook members, tabs, and slots so that a plurality of feed systems may be aligned and secured together.

An additional advantage of the present invention is that it provides a gravity feed system which is easily assembled and disassembled.

A further advantage of the present invention is that it includes a removable middle member allowing the expandable gravity feed system to support and dispense two rows of containers simultaneously.

Another advantage of the present invention is that the middle member can be secured to the fastener.

Still another advantage of the present invention is that it provides a stop member, securable to the fasteners, for preventing bottles from falling over the fasteners as they slide down the gravity feed system.

A further advantage of the present invention is that it allows for the dispensing of aseptic packages.

Another advantage of the present invention is that it provides a gravity feed system which may be expanded to include an infinite number of adjoining side tracks.

Another advantage of the present invention is that it can require as few as two different parts.

A further advantage of the present invention is that it may be stacked vertically.

Another advantage of the present invention is that it may be angled so that aseptic packages slide by gravity down ribbed side tracks.

Yet another advantage of the present invention is that the width between adjoining side tracks may be varied to accommodate containers of varying widths, either by varying the width of the fastener itself or by varying the positioning of the corrugated portion of a particular fastener in relation to the corrugated end member.

Additional features and advantages are described in, and will be apparent from, the detailed description of the preferred embodiments and from the drawings.

BRIEF DESCRIPTION OF THE DRAWINGS

FIG. 3 illustrates an exploded view of a portion of a further preferred embodiment of the expandable gravity feed system of this invention with parts broken away to show various details.

FIG. 3*a* illustrates a cross-sectional view of the gravity feed system of FIG. 3 taken along lines 3*a*—3*a*.

FIG. 4 illustrates a cross-sectional view of the gravity feed system of FIG. 3 taken along lines 4—4, with an expanded embodiment of the gravity feed system shown in phantom, dotted lines.

DETAILED DESCRIPTION OF THE PREFERRED EMBODIMENTS OF THE INVENTION

Figure 1:
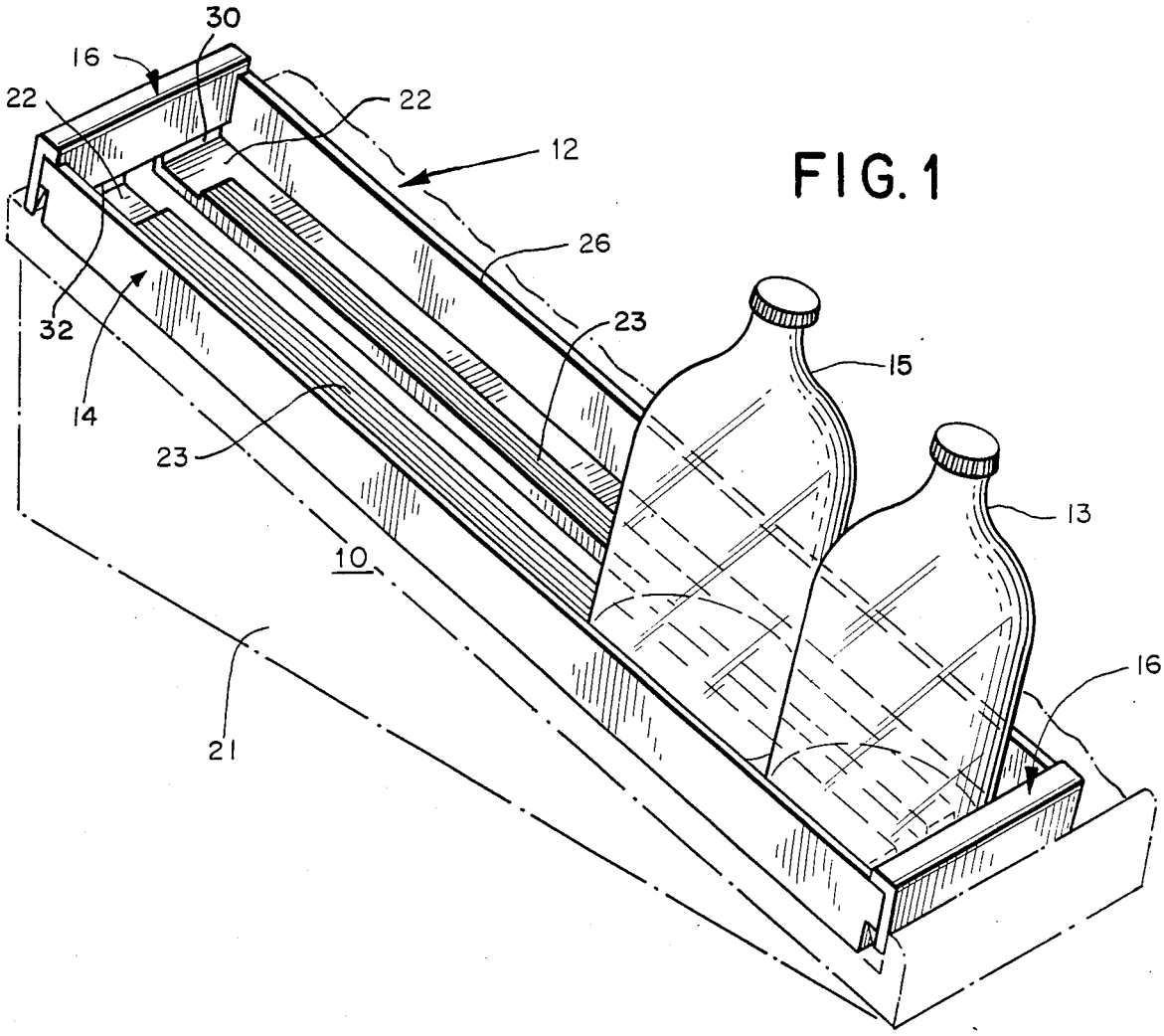
FIG. 1 is a perspective view of a preferred embodiment of the expandable gravity feed system of this invention.

Referring now to the drawings, FIG. 1 illustrates a preferred embodiment of the shelf-supported expandable gravity feed system 10 of the present invention, having side members 12 and 14 and a pair of fasteners 16. The feed system 10 is designed to accommodate in a shelf array a series of cans, bottles or packages of each. As will be described in greater detail below, the side members 12 and 14 and fasteners 16 create a feed system 10 designed to be supported by a standard inclined shelf such as used in supermarket refrigerators for displaying beverages for sale. By varying the lengths and/or attachment positions of the fasteners 16, the width of the feed system 10 may be expanded or contracted to accommodate bottles, containers and packages of varying sizes.

As will be more fully described below, the feed system 10 is especially designed to accommodate a row of bottles, cans, or other containers in an upright position. To simplify the description of the invention, hereinafter the bottle 13 should be interpreted as alternatively referring to a can or other container. The feed system 10 is also designed so that it can accommodate "six packs" of bottles or cans, even when they are contained in cardboard. As used herein "six pack" refers to a package or grouping of six bottles or cans.

In the preferred embodiment shown in the drawings, two side members 12 and 14 are provided, having a support track 22, a wall 26, and end members 30 and 32. As will be described in greater detail below, the side members 12 and 14 are interconnected at their end members 30 and 32 by fasteners 16 to create the feed system 10.

Figure 2:
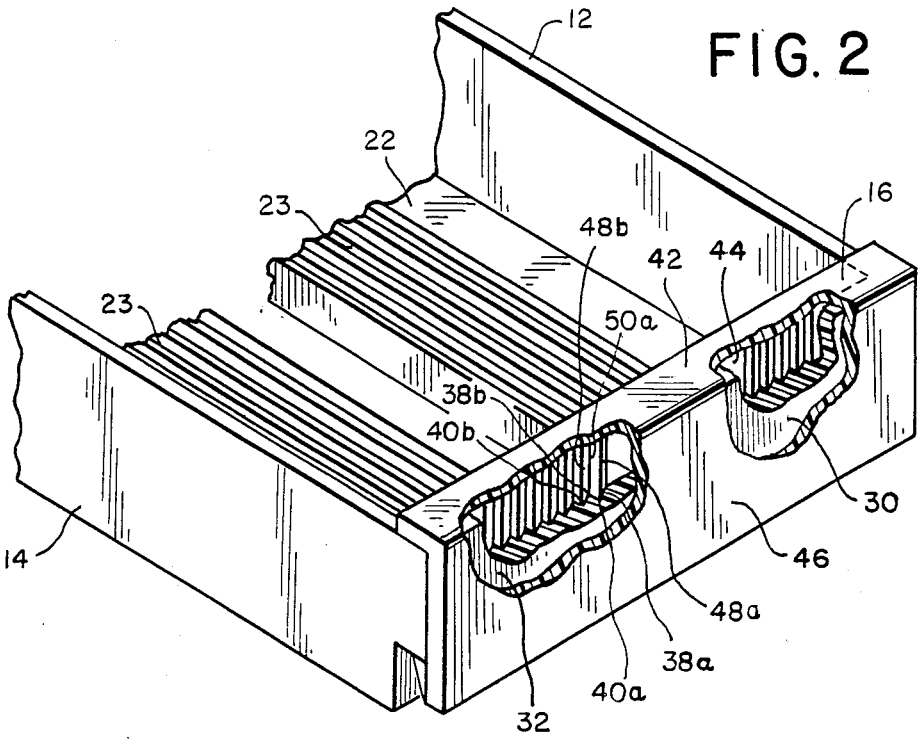
FIG. 2 illustrates a portion of the expandable gravity feed system of FIG. 1 with parts broken away to show various details.

The feed system 10 is designed to display and dispense a row of bottles 13 from an inclined shelf or surface 21. As a bottle 13 is removed from the front of the feed system 10, a second bottle 15 located behind the removed bottle slides to the front of the system 10 to take its place. According to the present invention, other bottles (not shown) that may be positioned behind the second bottle 15 will also slide to the front of the system 10 as the bottle 13 is removed. As shown in FIG. 2, to provide a smaller surface area in contact with the bottles 13 and 15, and thereby to reduce the friction force between the support tracks 22 and the bottles 13 and 15, the support tracks 22 include ribbed portions 23. The ribbed portions 23 allow the bottles 13 to slide down the feed system 10 in an upright position.

As illustrated in FIG. 3, to provide stability to upright bottles 13 each support track 22 may also include a single elongated rib 61. The elongated rib 61 is located between the ribbed portion 23 and wall 26 and stabilizes the bottle 13 as it slides down the support tracks 22.

Referring now to FIGS. 2, 3, 3*a* and 4 the side members 12 and 14 are interconnected at their end members 30 and 32 by fasteners 16 to form the feed system 10. The fasteners 16 are designed to removably receive at least a portion of the end members 30 and 32, thereby securing side members 12 and 14 in parallel relationship to each other.

To facilitate the interconnection of the side members 12 and 14, the end members 30 and 32 are corrugated. As used herein, the term "corrugated" means that at least a portion of the end members 30 and 32 has an alternating ridge 38 and groove 40 construction. Thus, as shown in FIG. 2, end members 30 and 32 have a first ridge 38*a*, a first groove 40*a*, a second ridge 38*b*, a second groove 40*b*, and so forth.

Correspondingly, the fasteners 16 have a corrugated construction and include a top portion 42 and side walls 44 and 46 which define a channel 45 therebetween. The channel 45 is constructed so that at least a portion of the end members 30 and 32 may be removably received therein. To securely position the end members 30 and 32 within the channel 45, at least one of the inner walls of the fastener 16 is corrugated. In the preferred embodiment illustrated, side wall 44 of the fastener 16 is corrugated and includes an alternating ridge 48 and groove 50 construction.

Figure 5:
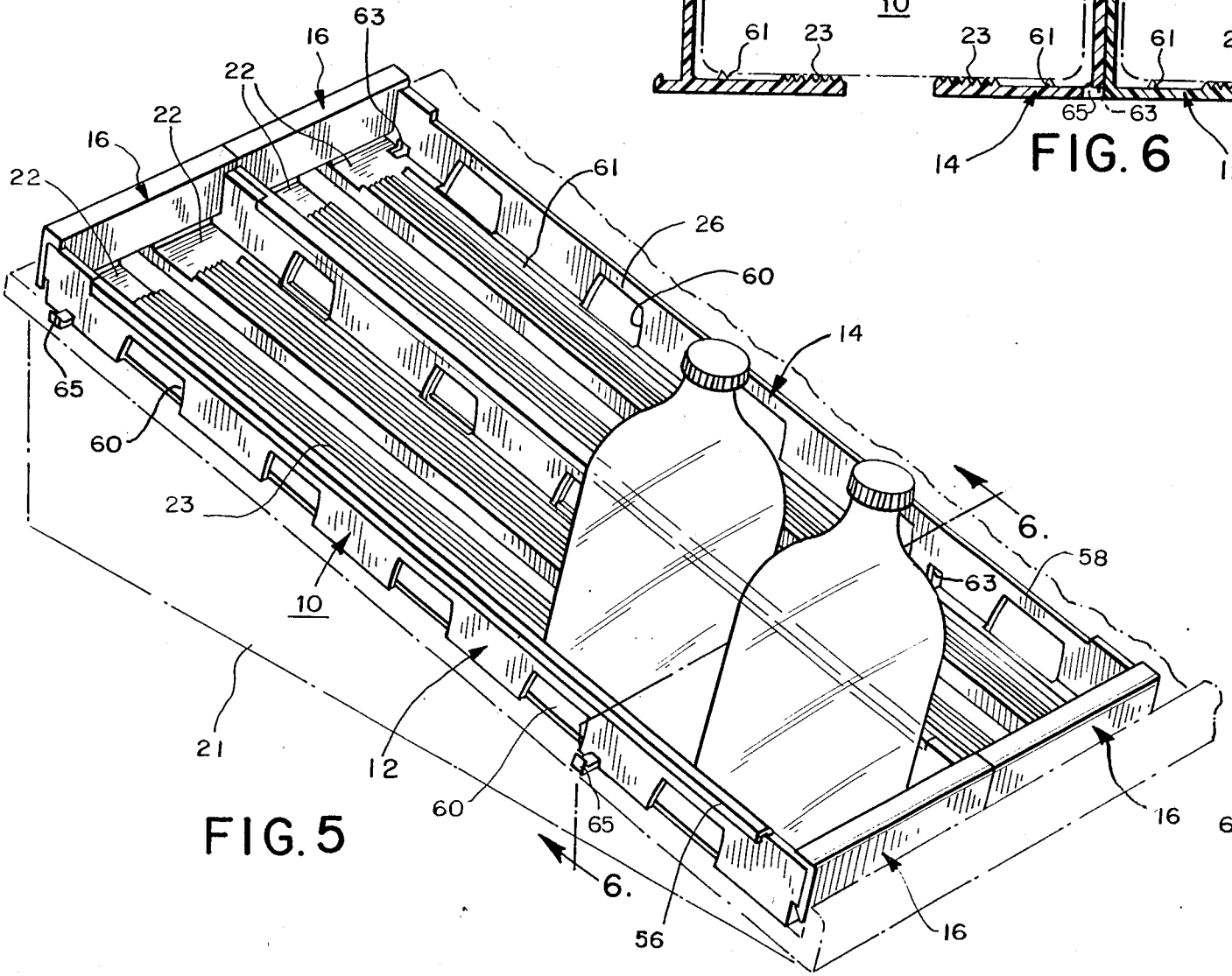
FIG. 5 illustrates a further preferred embodiment of the gravity feed systems of this invention.

By way of example, FIGS. 2, 4 and 5 illustrate the interconnection between the fastener 16 and the end member 30. When the fastener 16 is positioned over the end member 30, the end member 30 is received within the channel 45 so that a ridge 38 of the end member 30 is received within a groove 50 of the fastener 16, and a ridge 48 of the fastener 16 is received within a groove 40 of the end member 30. As specifically illustrated in FIG. 2, the ridge 48*a* is received within the groove 40*a*, and the ridge 38*b* is received within the groove 50*a*. Thus, the end member 30 is slidably received within the fastener 16. When an end member 30 or 32 is received within a fastener 16, the corrugated construction of the end member 30 or 32 prevents lateral movement of the end member 30 or 32 with respect to the fastener 16. Also, when two end members 30 and 32, are received by a fastener 16, their lateral movement with respect to each other is prevented, thereby securing the side members 12 and 14 in parallel relationship.

As shown in FIG. 4, by placing a ridge 48 of the fastener 16 in various grooves 40 of the end member 30, the distance between the interconnected end members 30 and 32 may be varied, thereby expanding or contracting the width of the feed system 10. In a preferred embodiment, the ridges 48 and the grooves 50 of the fastener 16 and end members 30 and 32 are constructed such that the feed system 10 can be expanded or contracted in increments of about one-eighth of an inch.

By providing ridges 38 and grooves 40 such that the first ridges 38*a* and 48*a* are approximately one-eighth inch from the second ridges 38*b* and 48*b*, it is possible to use only two pairs of fasteners 16 having lengths, respectively, of about $3\frac{1}{2}$ inches and about 6 inches, and, thereby create a feed system 10 which can accommodate a quart bottle standing vertically and can be expanded to hold a "six pack". Thus, by using two sets of fasteners 16 of differing lengths, it is possible to provide an expandable gravity feed shelf 10 which can accommodate a wide variety of commercially available bottles 13 and packages of bottles 13.

To create a feed system 10 which is stable and to produce an integral assembly, the fasteners 16 and end members 30 and 32 cooperate to provide a locking mechanism. As illustrated in FIG. 3 and 3*a*, the inner wall of the side wall 46 includes a locking flange 53. Correspondingly, the end members 30 and 32 include a recessed portion 55. The recessed portion 55 and locking flange 53 cooperate to securely position the fastener 16 to the end members 30 and 32. To this end, the locking flange 53 is designed to snap into the recessed portion 55 when the fastener 16 receives a portion of the end members 30 and 32.

Figure 15:
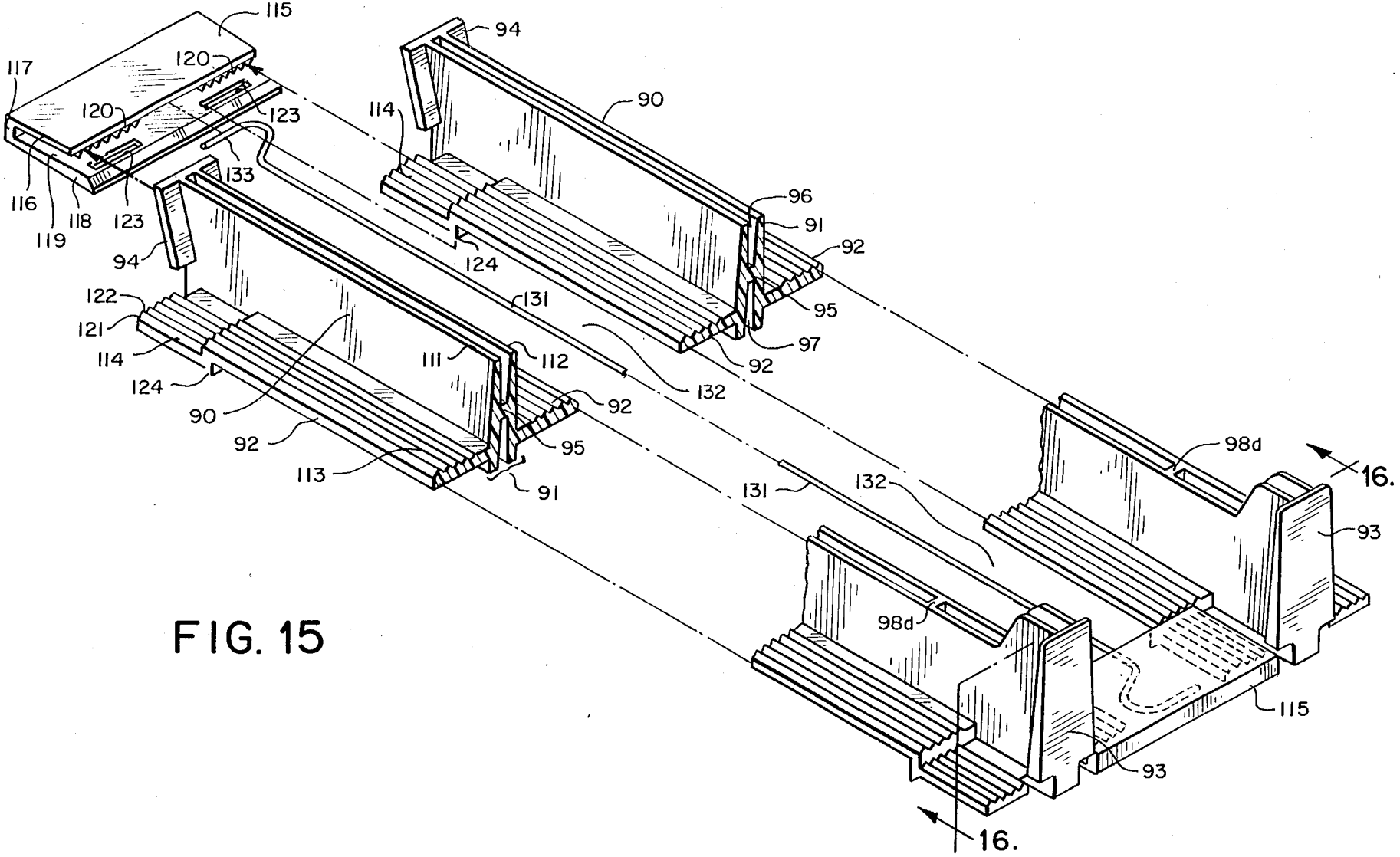
FIG. 15 is an exploded perspective view of the expandable gravity feed system of FIG. 12, with parts broken away to show various details, and certain hidden details shown as dotted lines.

An example of a further preferred embodiment of the interconnection between end members and fasteners is illustrated in FIGS. 12–19. In this embodiment, as illustrated in FIG. 15, the fastener 115 has a dual corrugated construction 120 including sidewalls 116 and 118 which define a channel 119 therebetween. The corrugated end member 114 is slidably received within the fastener 115. As shown in FIGS. 12–19, the fastener is received in a horizontal orientation with respect to the corrugated end members, as opposed to the vertical orientation illustrated in FIGS. 1–11. In the same fashion as earlier described, the corrugated ridge and groove construction of end member 114 and fastener 115 prevents lateral movement of the end member when the fastener is positioned thereon. This embodiment of the invention incorporates a locking flange 124 on the underside of support track 92 which snaps into slot 123 when fastener 115 is properly positioned on end member 114.

Referring again to FIGS. 1–11, side wall 46 of the fastener includes a front face 51 on which an identification, such as a brand name can be applied. To this end, the front face 51 is smooth so that the identification may be silk screened, hot stamped or placed on by some other means known in the art.

Once constructed from its components, the feed system 10 is positioned on a surface or supported from a wall or shelf, and the bottles 13 to be stored or dispensed from the feed system 10 are located on the support tracks 22 between the walls 26. Preferably the system is located on an inclined surface 21 so that the bottles 13 located on the support tracks 22 are urged towards the lowermost end of the inclined surface 21 by gravity. To facilitate the movement of bottle 13 down the feed system 10, the side members 12 are constructed from a material with a low coefficient of friction.

In a preferred embodiment, the side members 12 and 14 are constructed from a hi-impact polystyrene mixed with a silicone carrier. This composition provides a feed system 10 with a coefficient of friction sufficiently low to allow an upright bottle to slide from one end of the feed system 10 to the other when the feed system is inclined at a slope of approximately 5° to 8°. Due to the construction of the feed system 10 even oversized bottles such as two liter containers, which because of their high centers of gravity are difficult to dispense from a gravity feed system, may be dispensed from the feed system 10. The feed system 10 is also designed so that it can accommodate "six packs" of bottles or cans, even when they are contained in cardboard.

Figure 6:
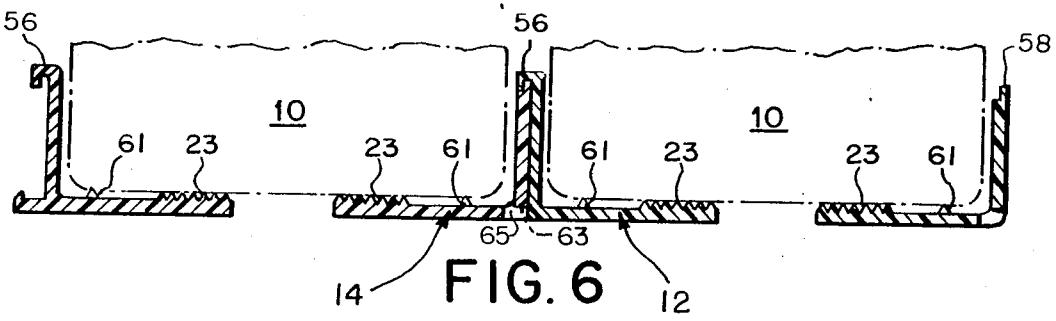
FIG. 6 illustrates a cross-sectional view of the gravity feed systems of FIG. 5 taken along lines 6—6.
Figure 6A:
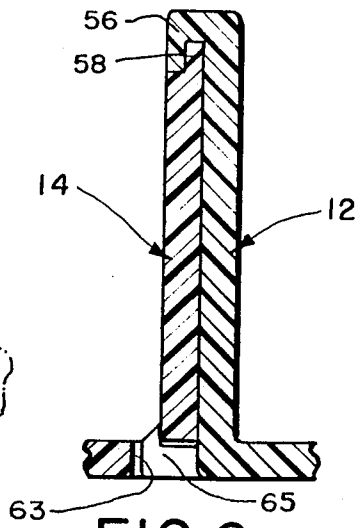
FIG. 6*a* illustrates an enlarged view of a portion of the gravity feed systems of FIG. 6.

In a further preferred embodiment, illustrated in FIG. 5, the side members 12 and 14 are constructed so that two or more feed systems 10 may be secured in parallel relationship to each other. To this end, as illustrated in FIGS. 6 and 6*a*, one of the side members 12 includes a hook member 56 while the other side member 14 includes a lip member 58. The hook member 56 is designed to receive the lip member 58 so that two feed systems may be secured in parallel relationship to each other. Correspondingly, one of the side members 14 includes a slot 63 and the other side member 12 includes a tab 65. The tab 65 is constructed so that it snaps into the slot 63 locking the side members 12 and 14 in parallel relationship.

As further illustrated in FIG. 5, the side members 12 and 14 may include holes 60. This construction provides a feed system 10 with sufficiently stable walls 26 while at the same time saving material, and also providing a means of circulating cooled air for refrigerating the stored product.

Figure 7:
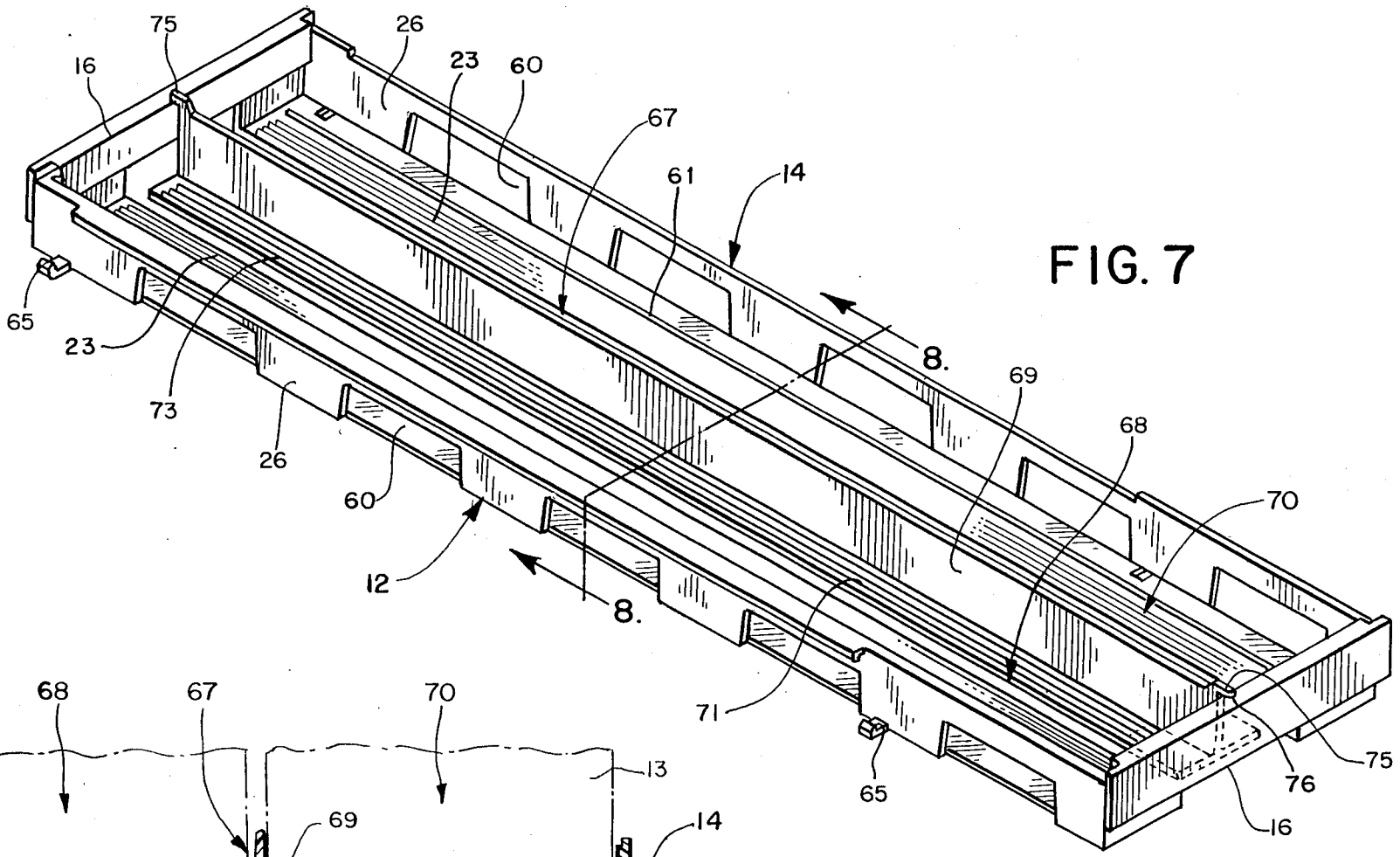
FIG. 7 illustrates a further preferred embodiment of the expandable gravity feed system of this invention.
Figure 8:
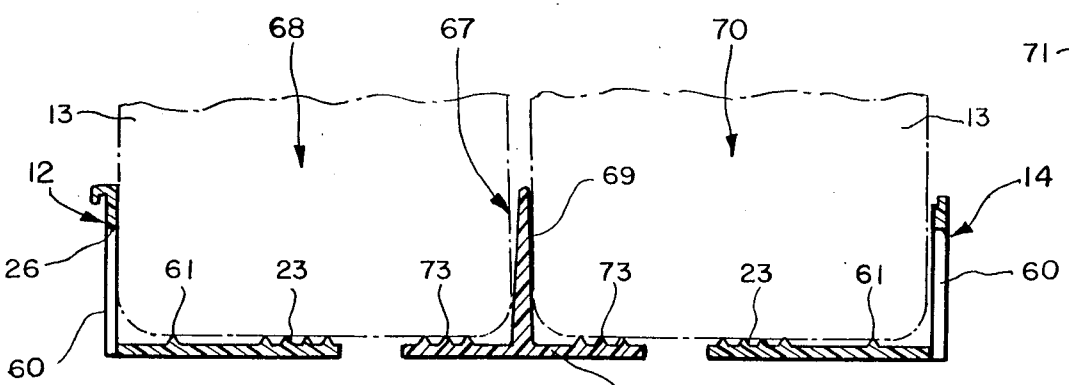
FIG. 8 illustrates a cross-sectional view of the expandable gravity feed system of FIG. 7 taken along lines 8—8 of FIG. 7.
Figure 9:
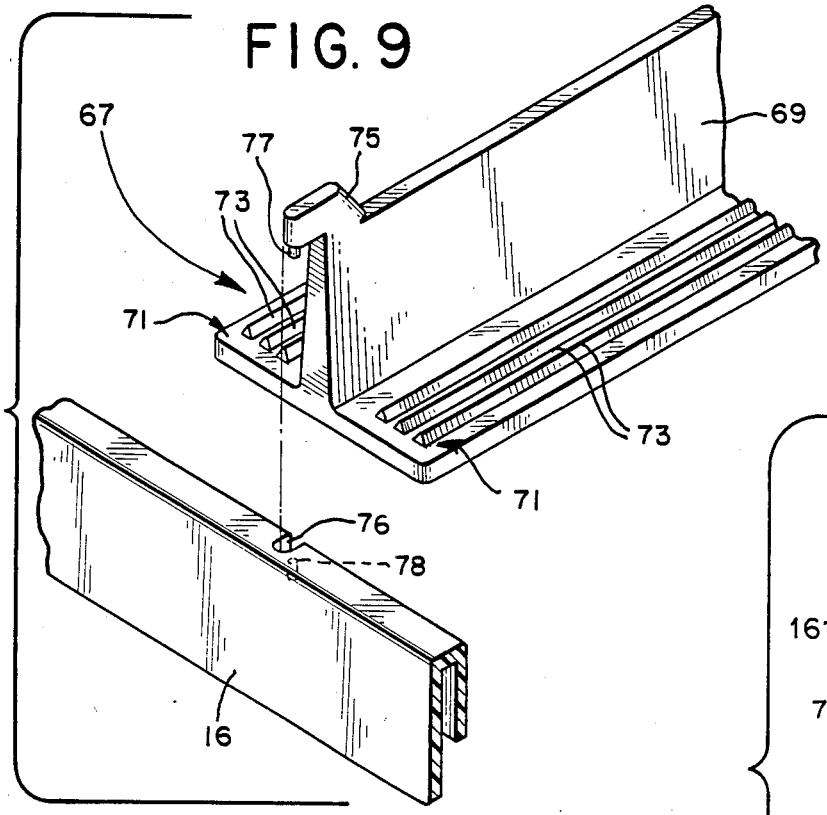
FIG. 9 illustrates an enlarged view of a portion of the expandable gravity feed system of FIG. 7.

In another embodiment illustrated in FIGS. 7–9, the expandable gravity feed system 10 includes a removable middle member 67. Preferably, the removable middle member 67 includes a wall 69 and support tracks 71. The support tracks 71 are located on opposing sides of the wall 69 and include a ribbed portion 73. In use, the middle member 67 is secured between side walls 12 and 14 and divides the gravity feed system 10 so that two rows 68 and 70 of bottles 13 can be supported and dispensed simultaneously. To this end, the middle member 67 includes end members 75 which allow the middle member to be secured to the fasteners 16. The end members 75 are designed to be received within a slot 76 in the fastener 16.

As illustrated in FIG. 9, to secure the middle member 67 to the fastener 16 a flange 77 may be located on the end member 75 and received within an aperture 78 in the fasteners. Thus, the middle member 67 may be removably secured between the side walls 12 and 14. When so secured the support tracks 71 of the middle member 67 and a corresponding support track 22 of the side member 12 and 14 provide a feed unit which can support and dispense bottles 13.

Figure 11:
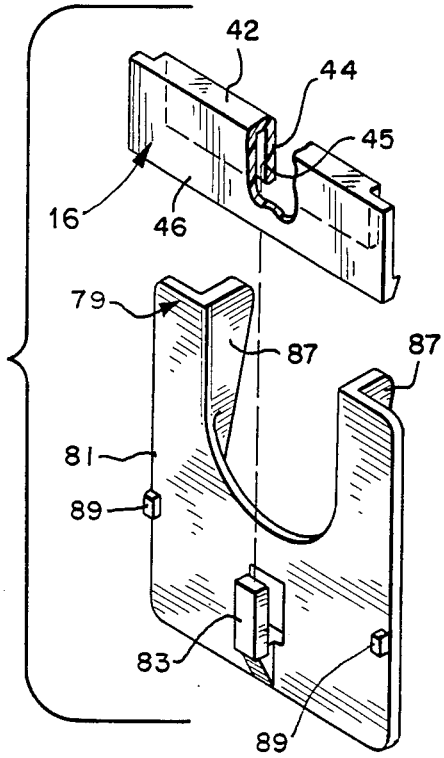
FIG. 11 illustrates an exploded view of a portion of the expandable gravity feed system of FIG. 10.
Figure 10:
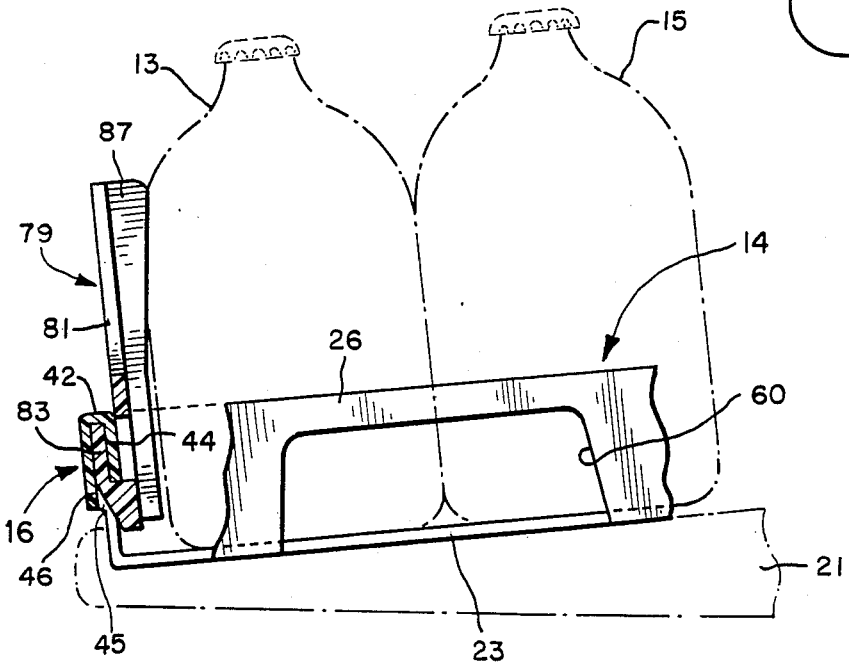
FIG. 10 illustrates a further preferred embodiment of the expandable gravity feed system of this invention.

As illustrated in FIGS. 10 and 11, the expandable gravity feed system 10, may include a stop member 79. The stop member 79 is designed to prevent bottles 13 from falling over the fastener 16 as they slide from one end of the feed system 10 to the other.

As illustrated in FIG. 11, the stop member 79 is constructed so that it is securable to the fastener 16. To this end, the stop member 79 includes a front surface 81 which includes an extending flange 83. The extending flange 83 is designed to engage the channel 45 of the fastener 16. Flanges 89 are located on opposing sides of the front surface and prevent the stop member 79 from wobbling when it is secured to the fastener 16. The stop member 79 also includes extending elongated shoulder members 87 which prevent an oversized bottle 13 from falling over the fastener 16 after it has slid down the support tracks 22.

Figure 12:
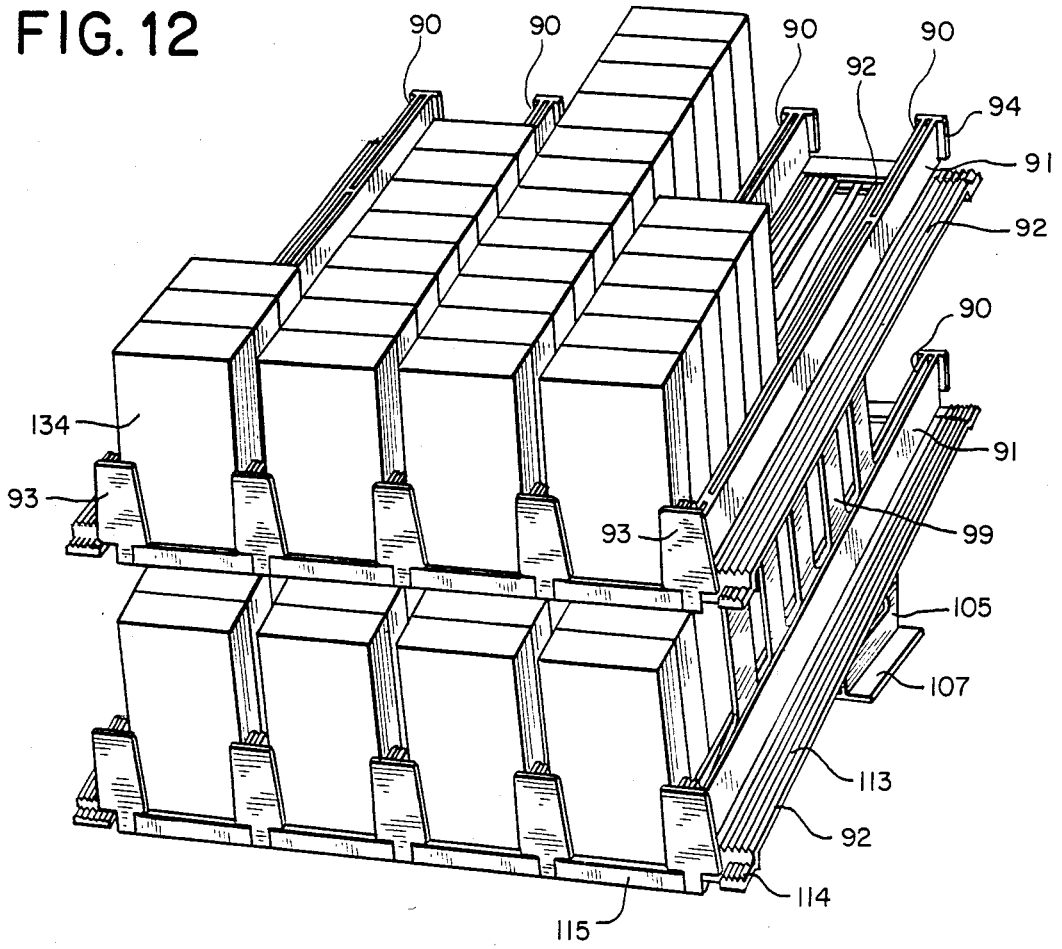
FIG. 12 is a perspective view of a further preferred embodiment of the gravity feed system of this invention.
Figure 14:
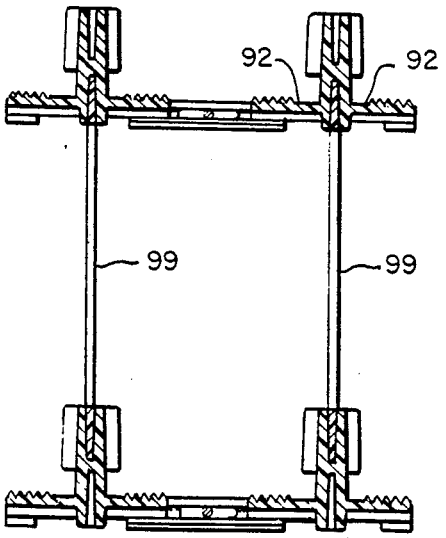
FIG. 14 is a cross-sectional view of the stacked configuration of the gravity feed system of FIG. 13 taken along lines 14—14.
Figure 13A:
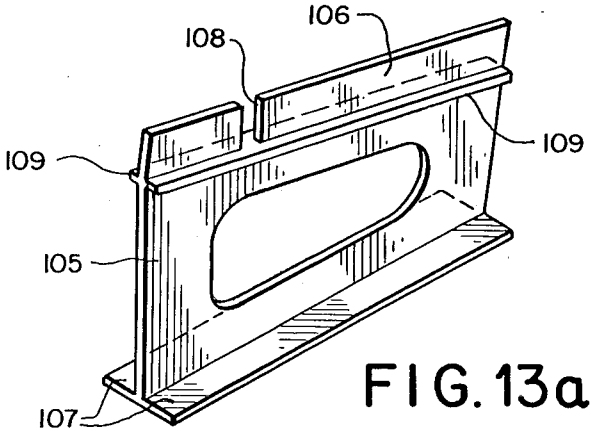
FIG. 13*a* is a perspective view of the angular base piece illustrated in FIG. 13.
Figure 13:
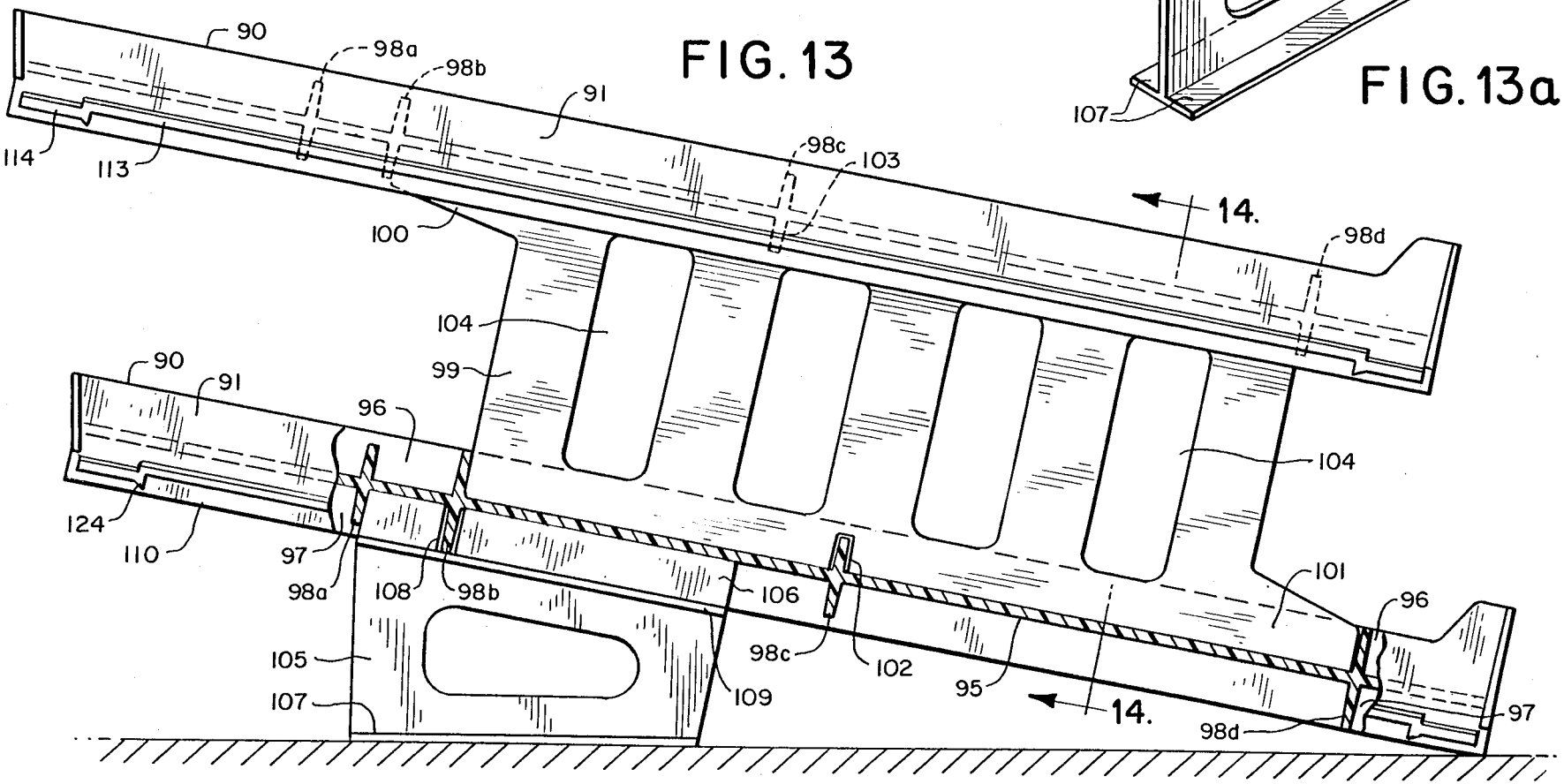
FIG. 13 illustrates the stacked configuration of the gravity feed system of FIG. 12, with parts broken away to show various details.
Figure 16:
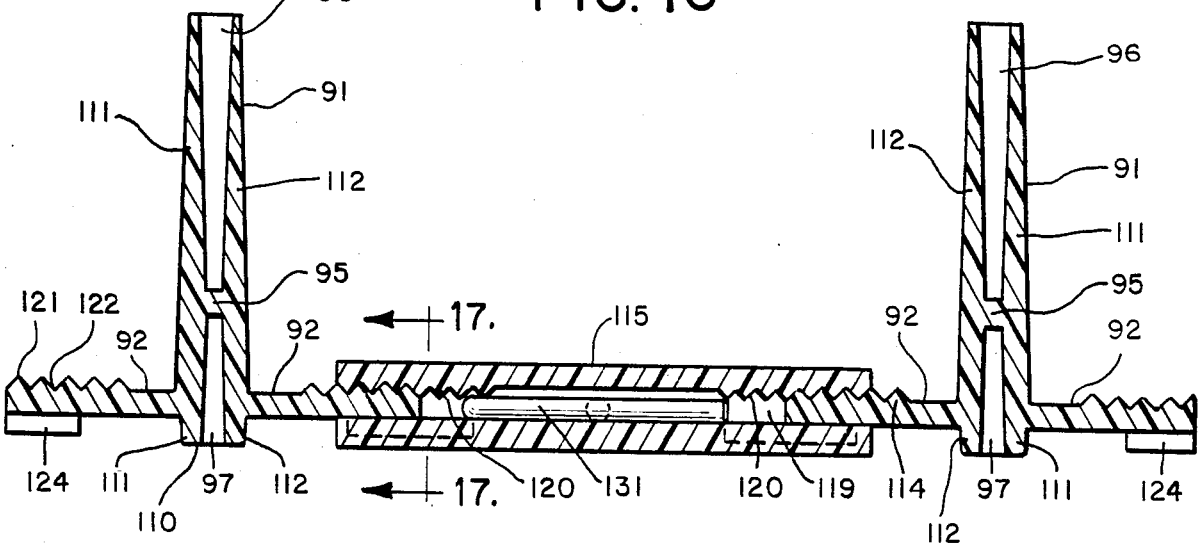
FIG. 16 is a sectional view along lines 16—16 of FIG. 15.

Still another preferred embodiment is illustrated in FIGS. 12–19. This embodiment is specially adapted for displaying and dispensing aseptic packages, that is, cardboard type containers. The side members 90 of this embodiment are identically constructed. As shown in FIG. 15, each side member includes a middle member 91 having a pair of support tracks 92, one positioned on either side of middle member 91, a front end member 93 and a rear end member 94. Preferably, as shown in FIGS. 15 and 16, the middle member 91 includes an inner opposing wall 112 and an outer opposing wall 111 connected by a connecting rib 95. The opposing inner and outer walls 111, 112, and rib 95 form an upper channel 96 and lower channel 97 in the middle member. As shown in FIG. 13, a plurality of spacer ribs 98*a*, 98*b*, 98*c*, and 98*d* are spaced within the upper channel 96 and lower channel 97. These spacer ribs impart stability to the middle member 91, and are designed to accept vertical separators 99. Each vertical separator includes an upper blade 100 and a lower blade 101. The lower blade 101 contains a lower slot 102, and the upper blade 100 contains an upper slot 103. The lower blade 101 of vertical separator 99 is designed to be received in the upper channel 96 of middle member 91. When in place, lower blade 101 is bounded on either end by spacer ribs 98*b* and 98*d*, and spacer rib 98*c* is received by lower slot 102.

In order that the expandable gravity feed system may be stacked, the upper blade 100 of vertical separator 99 is designed to be received by the lower channel 97 of middle member 91. When in place, the upper blade 100 is bounded on either end by spacer ribs 98*b* and 98*d*, and spacer rib 98*c* is received by upper slot 103.

It is preferred that the preferred embodiment shown in FIGS. 12–19 not be stacked more than three feed systems high, as higher stacking may cause the entire system to tip backwards.

Each vertical separator 99 is preferably imparted with a plurality of holes 104 which permit circulation of air.

Lower channel 97 is also designed to receive a base piece 105 which permits the gravity feed system to be angled, so that containers on support tracks 92 will slide forward. Each base piece 105 contains an upper blade 106 and a base member 107. The upper blade includes a slot 108. When in place, the upper blade 106 is received by lower channel 97. Preferably, spacer rib 98*b* receives slot 108, and spacer rib 98*a* bounds the higher end of upper blade 106. Base piece 105 also contains a pair of support ribs 109 positioned on either side of blade 106. These support ribs 109 impart further stability to base piece 105. When base piece 105 is positioned in lower channel 97, the support ribs 109 abut the bottom surface 110 of opposing walls 111 and 112, imparting further stability to the gravity feed system. Base piece 105 can be constructed to create different angles of inclination from that shown, and may be removed from the gravity feed system entirely so that the system may be placed directly on inclined shelves.

As shown in FIGS. 12 and 15, the support tracks 92 are located on opposing sides of the middle member 91, and include an upper ribbed portion 113. When in use, as shown in FIG. 12, the upper ribbed portion 113 supports aseptic packages 134, and allows them to slide forward by gravity in an upright position. The side members of this embodiment are preferably constructed from a hi-impact polystyrene mixed with a silicone carrier, as earlier described. As shown in FIG. 12, the composition of the side members in conjunction with the ribbed construction provides a coefficient of friction which allows an aseptic package 134 to slide from one end of the feed system to the other when the feed system is inclined. As earlier described, when one aseptic package 134 is removed from the front of the system, a second package located behind the removed package slides forward to take its place.

Each side track also contains a corrugated end member, hereinafter described as a lower ribbed portion 114, at each end. The lower ribbed portion 114 is designed to accept fasteners 115. In use, each fastener permits a pair of side members 90 to be secured in parallel relationship to each other, forming a feed system unit as shown in FIG. 12. This embodiment of the invention permits an infinite number of feed system units to be joined in parallel relationship to each other by joining side members to fasteners to side members, etc.

As shown in FIG. 15, each fastener 115 has a top portion 116, a side wall 117, and a bottom portion 118, which together define a channel 119. The channel is constructed so that the lower ribbed portion 114 of side track 92 may be removeably received therein. The inner surface of top portion 116 of fastener 115 contains two corrugated portions 120. Each corrugated portion is designed to slidably receive a lower ribbed portion 114 of support track 92. In this way, one fastener 115 connects two side members 90 as shown in FIGS. 15 and 16. Both the fastener 115 and lower ribbed portion 114 contain a plurality of ridges 121 and grooves 122 which allow the width between adjoining support tracks 92 to be varied by placing the corrugated portion of the fastener 115 over varying portions of the lower ribbed portion 114.

Fasteners 115 of different widths can also be used to vary the widths between adjoining support tracks, in order to accommodate correspondingly wider bottles, cans, or aseptic packages.

Figure 17:
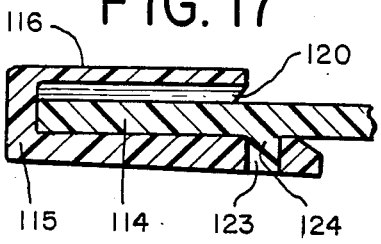
FIG. 17 is a sectional view along lines 17—17 of FIG. 16.

As shown in FIG. 15, the bottom portion 118 of each fastener 115 also contains two slots 123. These slots are designed to accept a locking flange 124, contained on the lower surface of the lower ribbed portion 114 of support track 92. The top portion 116 and bottom portion 118 of fastener 115 are angled slightly toward each other allowing the locking flange to snap into place within the slot 123 when the fastener 115 is properly positioned on the lower ribbed portion 114 of support track 92, as shown in FIGS. 16 and 17.

As shown in FIG. 12, each side member 90 also includes a front end member 93 and rear end member 94. In use, the front end members 93 prevent containers 134 from sliding out of the gravity feed system and back end members 94 prevent containers from being pushed out of the back of the unit.

Figure 19:
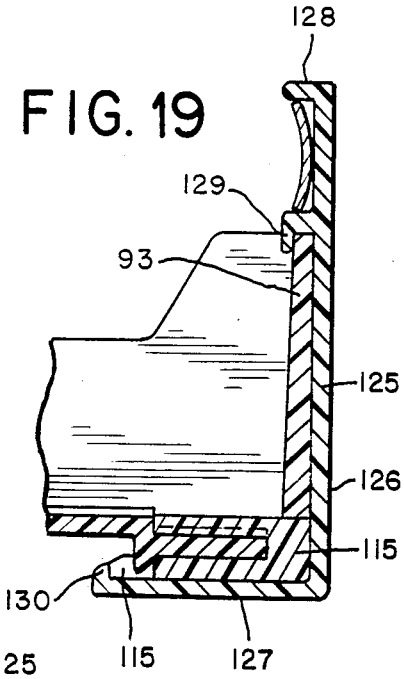
FIG. 19 is a sectional view taken along lines 19—19 of FIG. 18.
Figure 18:
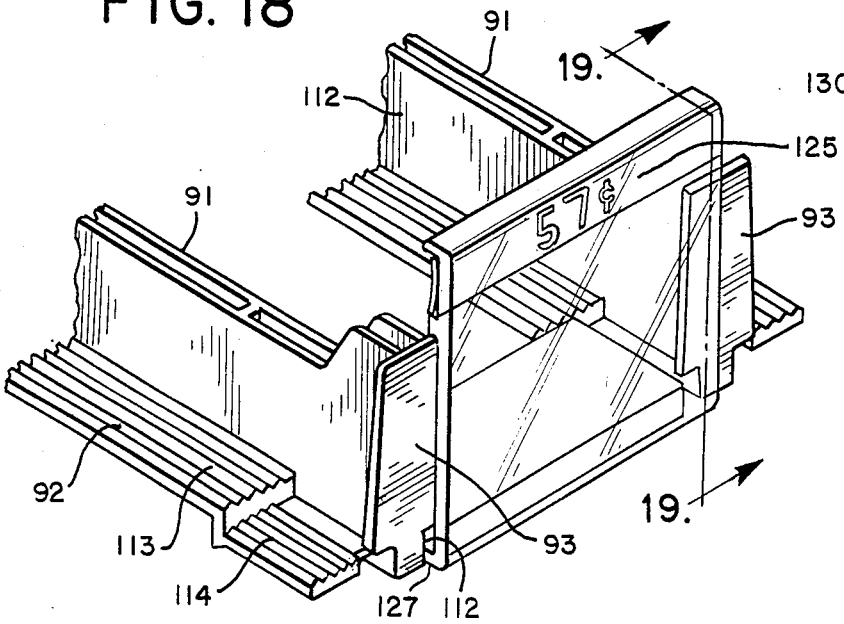
FIG. 18 is a perspective view of a portion of a further preferred embodiment of the expandable gravity feed system shown in FIG. 12.

This embodiment of the invention, as shown in FIGS. 18 and 19, may also be provided with a transparent stop member 125. This stop member prevents narrow containers from slipping between the front end members 93, while the transparent material of stop member 125 allows the label of the container to be seen. The stop member is preferably constructed of a clear plastic material.

The transparent stop member 125 has a front portion 126, a bottom portion 127, and a top portion 128. The inner surface of front portion 126 includes an upper hook portion 129. The bottom portion 127 includes a lower hook portion 130. In use, the upper hook portion 129 is first secured to adjacent front end members 93, and then the lower hook portion 130 is snapped into place over the bottom portion 118 of the fastener 115. The inner walls 112 of the middle 91 abut the lower hook portion 130 and upper hook portion 129, thereby preventing the bottle stop from sliding laterally out of position. As shown in FIGS. 18 and 19, the top portion 128 and upper hook portion 129 of the stop member permit a label to be placed therebetween.

This embodiment, as shown in FIG. 15, can also include a filler wire 131, which is placed within the open portion 132 between opposing support tracks 92. The filler wire 131 includes two hooked ends 133 which can be removably placed within the channels 119 of opposing fasteners 115. In use, the filler wire 131 prevents wide, narrow containers or bottles from slipping through the open portion 132 of the system. The filler wire is intended for use with containers having a larger width, but narrow depth, such as pintsized liquor bottles. Such containers require adjacent support tracks to be relatively far apart, creating a wide open portion 132 through which the container could fall were it to rotate as it slid down the support tracks.

It should be understood that various changes and modifications to the preferred embodiments described herein will be apparent to those skilled in the art. For example, a variety of containers in addition to those described herein can be used with the present invention, including, but not limited to, milk cartons, juice cartons, cereal boxes, yogurt containers, etc. Additionally, the number of gravity feed units which may be stacked vertically may exceed three if the present design is varied slightly to prevent tipping.

These and other changes and modifications can be made without departing from the spirit and scope of the present invention and without diminishing its attendant advantages. It is therefore intended that such changes and modifications be covered by the following claims.

We claim:

1. A gravity feed system comprising:

a pair of side members, each side member including a support track, a wall, and two end members, each of said end members being corrugated on at least one side; and two fastening means removably interconnectable with said end members, each fastening means having at least one corrugated side which cooperates with the corrugated sides of the end members on a pair of side members, so that said side members can be secured in parallel relationship to each other.

2. The gravity feed system of claim 1 wherein each of said fastening means includes two parallel wall members which define a channel therebetween, and at least one of said wall members is corrugated on an inner side so that said end members are slidably received within said channel.

3. The gravity feed system of claim 1 wherein said side member includes a middle member and two support tracks, one on each side of the middle member.

4. The gravity feed system of claim 1 wherein:

each of said fastening means includes a locking flange; and each of said end members includes locking flange receiving means for securing said fasteners to said end members.

5. The gravity feed system of claim 1 wherein the system is angularly supported by a pair of angular base members supporting each of said side members.

6. The gravity feed system of claim 1 wherein the wall includes an upper and lower channel, separated by a connecting rib.

7. The gravity feed system of claim 1 wherein each of said end members contains a locking flange; and each of said fastening means includes locking flange receiving means for securing said fasteners to said end members.

8. An expandable gravity feed system unit comprising:

a pair of side members, each side member including a support track, a wall, and two end members, each of said end members being corrugated on at least one side with a ridge groove construction; and a pair of fastening means for removably interconnecting said end members at a variety of locations thereby preventing lateral movement of said side members with respect to each other, said fastening means including two wall members which define a channel therebetween, and at least one of said wall members being corrugated on an inner side so that said wall member includes a plurality of ridges and grooves.

9. An expandable gravity feed system comprising:

two side members, each side member including a middle member and a ribbed support track on opposing sides of said middle member, an end member on both ends of said support tracks, each of said end members being corrugated on at least one side with a ridge groove construction;

said middle member including a pair of parallel, vertical walls, joined by a connecting rib, said walls and connecting rib defining an upper channel and a lower channel in said middle member; and a pair of fastening means for removably interconnecting said end members at a variety of locations thereby preventing lateral movement of said side members with respect to each other, said fastening means including two wall members which define a channel therebetween, and at least one of said wall members being corrugated on an inner side so that said wall member includes a plurality of ridges and grooves.

10. The expandable gravity feed system of claim 9 further comprising a pair of angular base members wherein each of said base members is removably received by the lower channel of one of said middle members.

11. The expandable gravity feed system of claim 9 further comprising a pair of vertical separators wherein each vertical separator is removably received by the upper channel of each of said middle members.

12. The expandable gravity feed system of claim 9 wherein each of said end members includes a locking flange; and each of said fastening means includes a locking flange receiving means for securing said fasteners to said end members.

13. An expandable shelf unit comprising:

two side members, each side member including a ribbed support track, a wall, and two end members, each of said end members being corrugated on at least one side thereby defining a plurality of ridges and grooves;

at least one pair of fastening means for removably interconnecting said side members, said fastening means including a pair of wall members which define a channel therebetween, and at least one of said wall members being corrugated on its inner side thereby defining a plurality of ridges and grooves so that when said side members are interconnected a ridge of each of said end members is received within a separate groove of said fastener; and locking means for securing said fasteners to said end member.

14. The expandable gravity feed system of claim 13, wherein each side member includes a stop means for preventing a container from sliding down said support tracks and falling over said fastener means.

15. The expandable gravity feed system of claim 13, further ocmprising a filler wire positioned between said channels of said fastener means, preventing a container from falling between said ribbed support tracks.

16. The gravity feed system of claim 1 further comprising means for dividing the gravity feed system so that each of said side members can support a separate row of containers, said dividing means including a wall and ribbed support tracks on opposite sides of said wall, and said dividing means being secured to the two fastening means between a pair of side members and in parallel relationship to the side members.

17. The expandable gravity feed system of claim 1 wherein the distance between said interconnected side members may be increased or decreased by varying the location of said fastening means relative to the end members.

18. The expandable gravity feed system of claim 1 further comprising a stop means for preventing a container from sliding down said support tracks and falling over said fastening means, said stop means being secured to a fastening means.

19. The expandable gravity feed system of claim 1 wherein one of said side members includes hook means for securing a side member of an additional gravity feed unit in parallel relationship to it, and said side members further include a locking tab and slot configuration for securing said side members to each other in parallel relationship to form a plurality of side by side gravity feed units.

20. The expandable gravity feed system of claim 8 wherein the distance between said interconnected side members may be varied by placing the ridges of said fastening means in various grooves in said end members.

21. An expandable gravity feed system unit comprising:

two side members, each side member including a ribbed support track, a wall, and two end members, each of said end members being corrugated on at least one side so that said end member includes a plurality of ridges and grooves; and a plurality of paired fastening means for removably interconnecting said end members at a variety of locations, each of said pairs of fastening means being of differing lengths so that the distance between said side members when they are interconnected may be varied by utilizing a different pair of fastening means.

* * * * *